United States Patent [19]

Bares et al.

[11] Patent Number: 5,061,964

[45] Date of Patent: Oct. 29, 1991

[54] DEVELOPER UNIT USING MAGNETIC TONER PARTICLES

[75] Inventors: Jan Bares; John S. Berkes, both of Webster; Bernard Grushkin, Pittsford, all of

[73] Assignee: Xerox Corporation, Stamford, Conn.

[21] Appl. No.: 556,500

[22] Filed: Jul. 20, 1990

[51] Int. Cl.[5] ..... G03G 15/06

[52] U.S. Cl. ..... 355/265; 355/246; 430/122

[58] Field of Search ..... 355/251, 253, 246, 265; 118/657, 658; 430/122

[56] References Cited

U.S. PATENT DOCUMENTS

| | | | |
|---|---|---|---|
| 3,262,806 | 7/1966 | Gourgé | 117/17.5 |
| 3,914,771 | 10/1975 | Lunde et al. | 346/74 ES |
| 4,102,305 | 7/1978 | Schwarz | 118/658 X |
| 4,342,822 | 8/1982 | Hosono et al. | 430/122 X |
| 4,797,335 | 1/1989 | Hiratsuka et al. | 118/657 X |

*Primary Examiner*—A. T. Grimley
*Assistant Examiner*—P. J. Stanzione
*Attorney, Agent, or Firm*—H. Fleischer; J. E. Beck; R. Zibelli

[57] ABSTRACT

An apparatus in which developer material comprising carrier granules and magnetic toner particles is transported closely adjacent to a latent image. The developer roller transporting the developer material is electrically biased. The electrical bias has a wave form that removes a substantially uniform distribution of magnetic toner particle sizes from the carrier granules and develops the latent image therewith.

14 Claims, 2 Drawing Sheets

DEVELOPER UNIT USING MAGNETIC TONER PARTICLES

Figure 1:
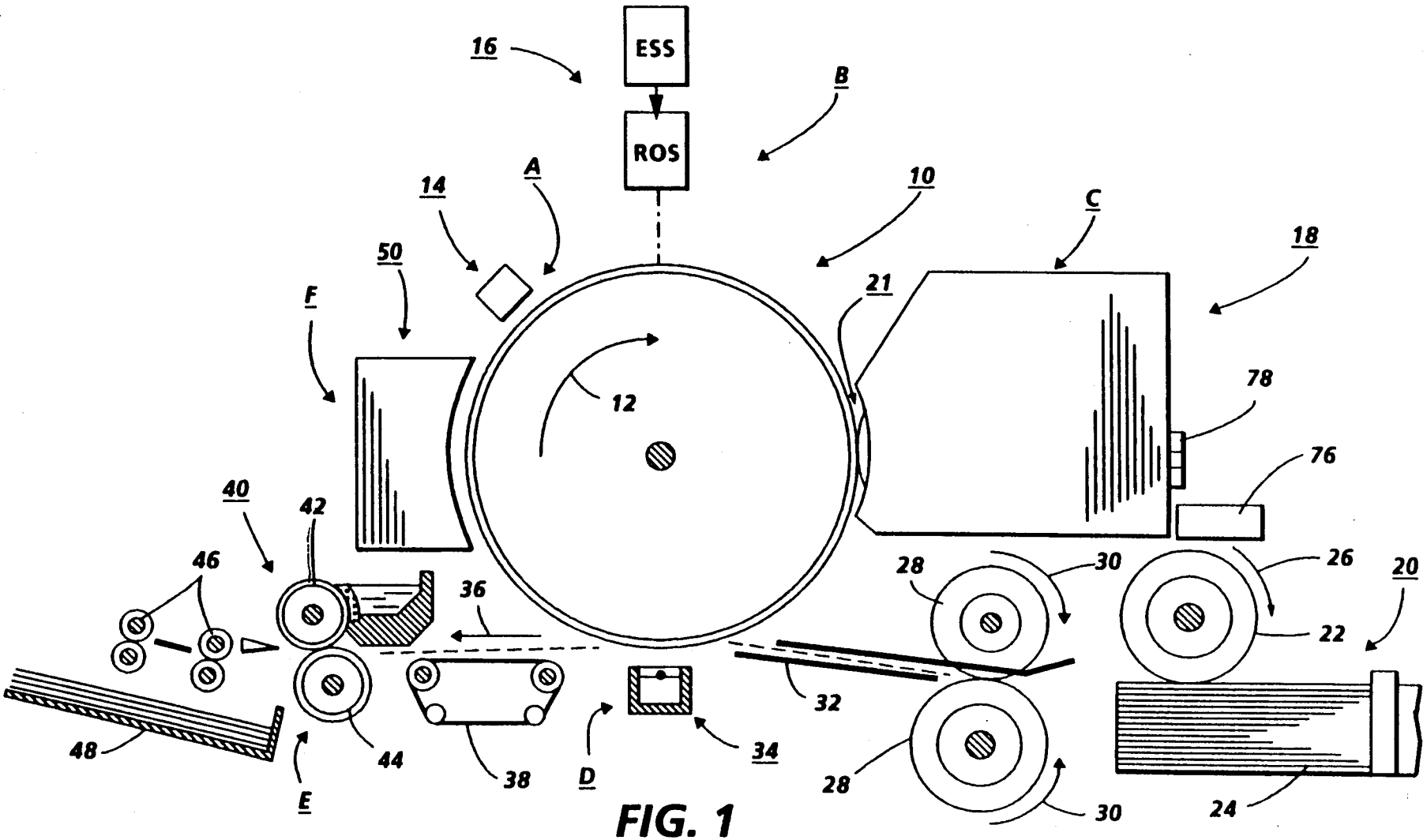

This invention relates generally to an electropohotographic printing machine, and more particularly concerns an apparatus for developing an electrostatic latent image with magnetic toner particles.

In the process of electrophotographic printing, a photoconductive member is uniformly charged and exposed to a light image of an original document. Exposure of the photoconductive member records an electrostatic latent image corresponding to the informational areas contained within the original document. After the electrostatic latent image is recorded on the photoconductive surface, the latent image is developed by bringing developer material into contact therewith. This forms a powder image on the photoconductive member which is subsequently transferred to a copy sheet and permanently affixed thereto in image configuration.

Electrophotographic printing has been particularly useful in the commercial banking industry by reproducing checks or financial documents with magnetic ink, i.e. by fusing magnetic toner particles thereon. Each financial document has characters or symbols imprinted thereon which are recognized as unique characters of a specified type font. The document, upon which the characters are printed, is advanced past a magnetizing station, where the magnetizable ink is subjected to a magnetic field which magnetizes the ink in accordance with the unique geometry of the imprinted characters. The magnetic characters each have their own unique magnetic field which may be read by a magnetic ink character recognition (MICR) reader and processed. Character edge definition is a critical parameter. MICR readers are particularly sensitive to this parameter. Unfortunately, printing machines using the electrophotographic process often produce ragged edges. Although visually this defect is very subtle, magnetic readability is affected measurably. Sharper edges will result from greater and more uniform development of the latent image. Hereinbefore, the latent image has been selectively developed. It appears that the magnetic forces between the toner particles and carrier granules prevent the release of some of the toner particles during development. This results in the small, i.e. less than 4 micrometers, and large, i.e. greater than 18 micrometers, toner particles being preferentially retained by the development system. For example, toner particles with 12% by volume greater than 18 micrometers become enriched in large particles to 50% by volume greater than 18 micrometers. In addition to improving the sharpness of the edges of the characters being printed, elimination of this type of selective development may substantially extend developer material life. Moreover, if selective development were eliminated, it would no longer be necessary to provide extremely narrow toner particle size distributions in the developer unit. This lowers the cost of the toner particles used in the developer unit. The following disclosures may be relevant to various aspects of the present invention:

U.S. Pat. No. 3,262,806
Patentee: Gourge
Issued: July 26, 1966

U.S. Pat. No. 3,914,771
Patentee: Lunde et al.
Issued: Oct. 21, 1975

U.S. Pat. No. 4,102,305
Patentee: Schwarz
Issued: July 25, 1978

The relevant portions of the foregoing patents may be briefly summarized as follows:

U.S. Pat. No. 3,262,806 discloses a DC biased magnetic brush roller.

U.S. Pat. No. 3,914,771 describes a developer roll having a non-magnetic outer cylindrical shell telescoped over a magnetic roller. Electronically conducting toner is metered onto the surface of the shell. A pulse control circuit is coupled to the shell and applies a voltage pulse when one of the magnetic sectors of the roller is in an optimum position for development.

U.S. Pat. No. 4,102,305 discloses a single component development system using particles that are magnetic and conductive. The particles are attracted by a magnetic rotor to a rotating tubular member. The tubular member is electrically biased by an AC voltage or a DC and AC voltage. Exemplary toner particles contain 50% by weight of magnetite.

In accordance with one aspect of the present invention, there is provided an apparatus for developing a latent image, including means for storing a supply of developer material comprising carrier granules and magnetic toner particles. Means are provided for transporting developer material closely adjacent to the latent image. Means electrically bias the transporting means with an electrical bias having a wave form that removes a substantially uniform distribution of magnetic toner particle sizes from the carrier granules and develops the latent image therewith.

Pursuant to another aspect of the present invention, there is provided an electrophotographic printing machine of the type in which an electrostatic latent image is recorded on a photoconductive member. The improvement includes means for storing a supply developer material comprising carrier granules and magnetic toner particles. Means are provided for transporting developer material closely adjacent to the electrostatic latent image recorded on the photoconductive member. Means electrically bias the transporting means with an electrical bias having a wave form that removes a substantially uniform distribution of magnetic toner particles sizes from the carrier granules and develops the electrostatic latent image therewith.

Figure 2:
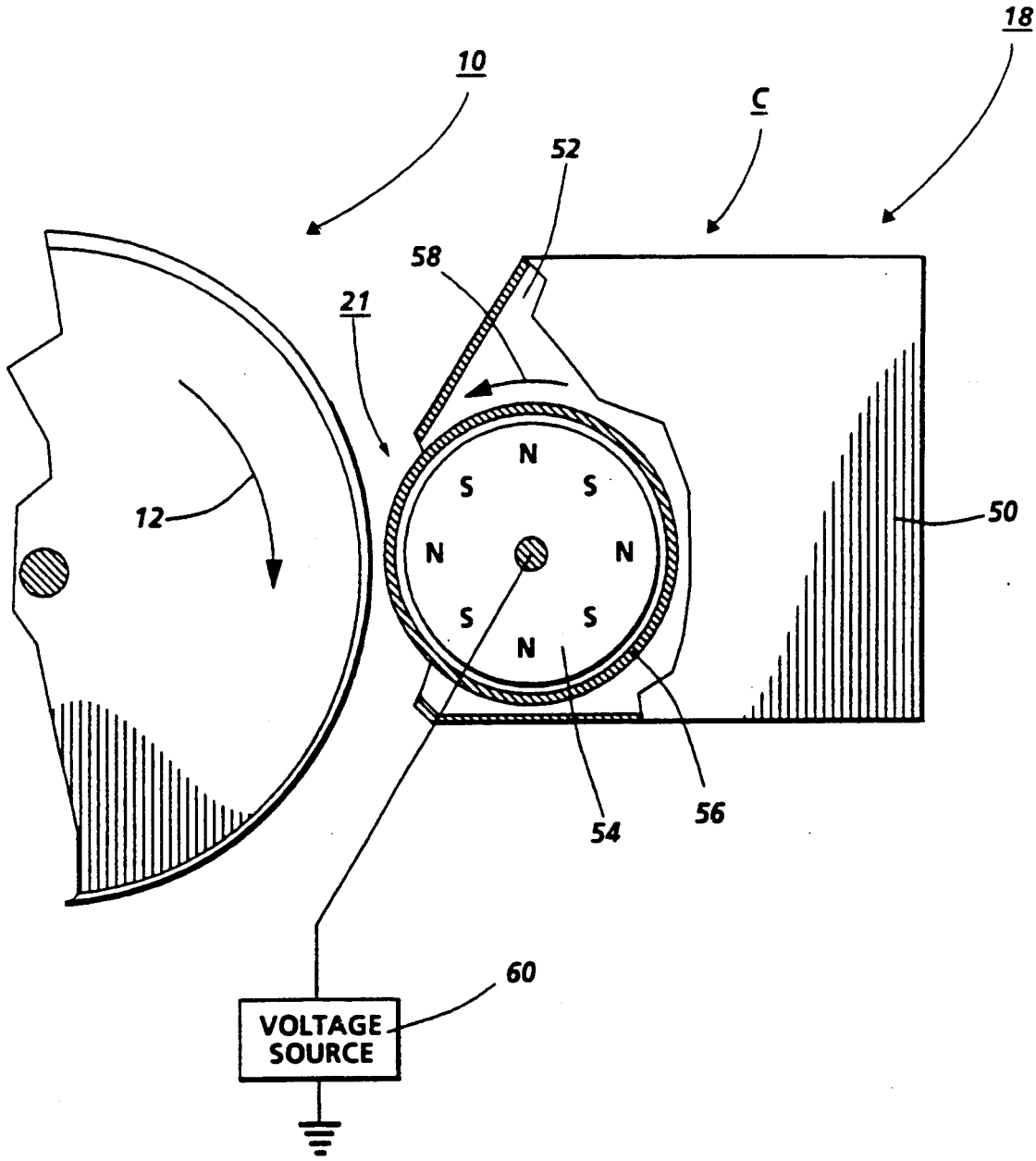

Other aspects of the present invention will become apparent as the following description proceeds and upon reference to the drawings, in which:

FIG. 1 is a schematic elevational view showing an illustrative electrophotographic printing machine incorporating the features of the present invention therein; and FIG. 2 is a fragmentary, elevational view showing the developer unit used in the FIG. 1 printing machine.

While the present invention will be described hereinafter in conjunction with a preferred embodiment thereof, it will be understood that it is not intended to limit the invention to this embodiment. On the contrary, it is intended to cover all alternatives, modifications and equivalents as may be included within the spirit and scope of the invention as defined by the appended claims.

For a general understanding of the features of the present invention, reference is made to the drawings. In the drawings, like reference numerals have been used throughout to designate identical elements. FIG. 1 schematically depicts the various components of an illustrative electrophotographic printing machine incorporating the features of the present invention therein. It will become evident from the following discussion that the present invention is equally well suited for use in a wide variety of printing machines and is not necessarily limited in its application to the particular printing machine described herein.

Inasmuch as the art of electrophotographic printing is well known, the various processing stations employed in the FIG. 1 printing machine will be shown hereinafter schematically and their operation described briefly with reference thereto.

As shown in FIG. 1, the illustrative electrophotographic printing machine employs a drum 10 having a photoconductive surface adhering to a conductive substrate. Preferably, the photoconductive surface comprises a selenium alloy with the conductive substrate being an electrically grounded aluminum alloy. One skilled in the art will appreciate that any suitable photoconductive material may be used. Drum 10 rotates in the direction of arrow 12 to advance successive portions of the photoconductive surface sequentially through the various processing stations disposed about the path of movement thereof.

Initially, a portion of the photoconductive surface passes through charging station A. At charging station A, a corona generating device, indicated generally by the reference numeral 14, charges the photoconductive surface to a relatively high, substantially uniform potential.

Next, the charged portion of the photoconductive surface is advanced through imaging station B. Imaging station B includes a raster scanning system, indicated generally by the reference numeral 16. The raster scanning system has a raster output scanner (ROS) 17 and an electrical subsystem (ESS) 19. ESS 19 is the control electronics which prepare and manage the image data flow to the ROS 17. A series of raster scan lines, in electronic form, are transmitted to ESS 19. This corresponds to the information desired to be printed. The signal corresponding to the information desired to be printed is transmitted from ESS 19 to ROS 17. ROS 17 lays out the information in a series of horizontal scan lines with each line having a specified number of pixels per inch. The ROS includes a laser having a rotating polygon mirror block associated therewith. ROS 17 exposes the charged photoconductive drum to record thereon, as an electrostatic latent image, the information desired to be printed. One skilled in the art will appreciate that in lieu of a laser, other suitable devices, such as light emitting diodes, may be used to irradiate the charged portion of the photoconductive drum so as to record the electrostatic latent image thereon.

After the electrostatic latent image is recorded on the photoconductive drum 10, drum 10 advances the electrostatic latent image to development station C. At development station C, a magnetic brush developer unit, indicated generally by the reference numeral 18, has a developer roll 21 that transports a developer material of carrier granules having magnetic toner particles adhering triboelectrically thereto closely adjacent to, or into contact with, the electrostatic latent image recorded on the photoconductive surface of drum 10. Developer roll 21 is electrically biased to remove a substantially uniform distribution of magnetic toner particle sizes from the carrier granules and develops the electrostatic latent image therewith. By uniform size distribution, it is meant that the distribution of particles sizes is the same as appears in the toner supply and/or chamber of the developer housing. In this way, the toner particles remaining in the developer unit are substantially uniformally distributed. The magnetic toner particles are preferably made from a ferromagnetic material, such as magnetite embedded in a resin binder. The latent image attracts the magnetic toner particles forming a powder image on the surface of photoconductive drum 10. Developer unit 18 will be described hereinafter in greater detail with reference to FIG. 2.

Drum 10 then advances the toner powder image to transfer station D. At transfer station D, a sheet of support material is moved into contact with the toner powder image. The sheet of support material is advanced to transfer station D by a sheet feeding apparatus, indicated generally by the reference numeral 20. Preferably, sheet feeding apparatus 20 includes a feed roll 22 contacting the uppermost sheet of a stack of sheets 24. Feed roll 22 rotates in the direction of arrow 26 to advance the uppermost sheet into a nip defined by forwarding rollers 28. Forwarding rollers 28 rotate in the direction of arrow 30 to advance the sheet into chute 32. Chute 32 directs the advancing sheet into contact with the surface of drum 10 in a timed sequence so that the toner powder image developed thereon contacts the advancing sheet at transfer station D.

Transfer station D includes a corona generating device 34 which sprays ions onto the backside of the sheet. This attracts the toner powder image from the surface of drum 10 to the sheet. After transfer, the sheet continues to move in the direction of arrow 36 on conveyor 38 to advance to fusing station E.

Fusing station E includes a fuser assembly, indicated generally by the reference numeral 40, which permanently affixes the transferred toner powder image to the sheet. Preferably, fuser assembly 40 includes a heated fuser roller 42 and a back-up roller 44. The sheet passes between fuser roller 42 and back-up roller 44 with the powder image contacting fuser roller 42. In this manner, the toner powder image is permanently affixed to the sheet. After fusing, forwarding rollers 46 advance the sheet to catch tray 48 for subsequent removal from the printing machine by the operator.

After the magnetic toner powder image is transferred from the surface of drum 10 to the sheet, drum 10 rotates through cleaning station F. At cleaning station F, a cleaning system, indicated generally by the reference numeral 50, removes the residual particles adhering to the surface of drum 10. In this way, the residual toner particles are removed from the surface of drum 10.

It is believed that the foregoing description is sufficient for purposes of the present invention to illustrate the general operation of an electrophotographic printing machine incorporating the features of the developer unit of the present invention therein.

Referring now to FIG. 2, there is shown the detailed structure of developer unit 18. As depicted thereat, developer unit 18 includes a housing 50 defining a chamber 52 storing a supply of developer material of carrier granules and magnetic toner particles therein. Developer roller 21 transports developer material closely adjacent to the surface of drum 10. Developer roller 21 has an elongated cylindrical magnetic rotor 54 disposed interiorly of and spaced from tubular member or sleeve 56. Sleeve 56 is non-magnetic and rotates in the direction of arrow 58. By way of example, magnet 54 is made from barium ferrite with sleeve 56 being made from aluminum having the exterior circumferential surface thereof roughened. Magnetic rotor 54 is mounted stationarily. However, one skilled in the art will appreciate that magnetic rotor 54 may also rotate. A metering blade (not shown), positioned closely adjacent to sleeve 56, regulates the quantity of developer material being advanced by sleeve 56.

Voltage source 60 electrically biases sleeve 56 with a chopped DC bias having a peak magnitude ranging from about 100 volts to about 500 volts and a frequency range of from about 0.2 KHZ to about 5 KHZ. In lieu of a chopped DC bias, a pulsed DC bias having the same range of magnitude may be used. By electrically biasing the developer roller in this manner, toner particle size selection is reduced or eliminated during development. One skilled in the art will appreciate that, alternatively, voltage source 60 may electrically bias sleeve 56 with an AC bias having a peak to peak magnitude ranging from about 200 volts to about 1000 volts. The AC voltage is applied at a frequency ranging from 0.2 KHz to about 5 KHz. The magnetic toner particles are made from a resin having magnetite embedded therein. The electrical bias applied on sleeve 56 by voltage source 60 removes from the carrier granules a substantially uniform distribution of magnetic toner particles ranging in size from less than 4 micrometers to greater than 18 micrometers. This uniform distribution of toner particles is transported on sleeve 56 closely adjacent to drum 10. The concentration of magnetite in each toner particle is at least 25% by weight. By way of example, one type of suitable toner contains about 30% by weight of magnetite coated with a stearate composition and 70% by weight of a copolymer of 65% styrene and 35% n-butylmethacrylate.

In recapitulation, the development apparatus of the present invention transports developer material on a developer roll closely adjacent to a photoconductive drum having an electrostatic latent image recorded thereon. The developer material has magnetic toner particles adhering triboelectrically to carrier granules. An electrical bias having a wave form that removes a substantially uniform distribution of magnetic toner particle sizes from the carrier granules is applied to the developer roller. These toner particles develop the latent image. In this way, development of the latent image is enhanced and toner particle size selection by the development system is reduced or eliminated.

It is therefore, apparent that there has been provided, in accordance with the present invention, a development apparatus that fully satisfies the aims and advantages hereinbefore set forth. While this invention has been described in conjunction with a preferred embodiment thereof, it is evident that many alternatives, modifications, and variations will be apparent to those skilled in the art. Accordingly, it is intended to embrace all such alternatives, modifications and variations that fall within the spirit and scope of the appended claims.

We claim:

1. An apparatus for developing a latent image, including:

means for storing a supply of developer material comprising carrier granules and magnetic toner particles with the magnetic toner particles in said storing means having a substantially uniform size distribution;

means for transporting developer material closely adjacent to the latent image; and means for electrically biasing said transporting means with an electrical bias having a wave form that removes a substantially uniform distribution of magnetic toner particle sizes from the carrier granules and develops the latent image therewith with the distribution of magnetic toner particle sizes removed from said transporting means being substantially equal to the distribution of magnetic toner particle sizes in said storing means so that the distribution of magnetic toner particle sizes in said storing means remains substantially constant.

2. A apparatus according to claim 1, wherein said electrical biasing means electrically biases said transporting means with a chopped DC bias.

3. An apparatus according to claim 1, wherein said electrical biasing means electrically biases said transporting means with an AC bias.

4. A apparatus according to claim 1, wherein said electrical biasing means electrically biases said transporting means with a pulsed DC bias.

5. An apparatus according to claim 1, wherein said transporting means includes:

a rotatably mounted tubular member adapted to transport developer material closely adjacent to the member; and an elongated magnet disposed interiorly of said tubular member for attracting developer material thereto.

6. An apparatus according to claim 5, wherein said electrical biasing means electrically biases said tubular member with the wave form of the electrical bias removing from the carrier granules a substantially uniform distribution of magnetic toner particles ranging in size from less than 4 micrometers to greater than 18 micrometers and develops the latent image therewith.

7. An apparatus according to claim 6, wherein the magnetic toner particles have a concentration of magnetite of at least 25% by weight.

8. An electrophotographic printing machine of the type in which an electrostatic latent image is recorded on a photoconductive member, wherein the improvement includes:

means for storing a supply developer material comprising carrier granules and magnetic toner particles with the magnetic toner particles in said storing means having a substantially uniform size distribution;

means for transporting developer material closely adjacent to the electrostatic latent image recorded on the photoconductive member; and means for electrically biasing said transporting means with an electrical bias having a wave form that removes a substantially uniform distribution of magnetic toner particles sizes from the carrier granules and develops the electrostatic latent image therewith with the distribution of magnetic toner particle sizes removed from said transporting means being substantially equal to the distribution of magnetic toner particle sizes in said storing means so that the distribution of magnetic toner particle sizes in said storing means remains substantially constant.

9. A printing machine according to claim 8, wherein said electrical biasing means electrically biases said transporting means with a chopped DC bias.

10. A printing machine according to claim 8, said electrical biasing means electrically biases said transporting means with an AC bias.

11. A printing machine according to claim 8, wherein said electrical biasing means electrically biases said transporting means with a pulsed DC bias.

12. A printing machine according to claim 8, wherein said transporting means includes:

a rotatably mounted tubular member adapted to transport developer material closely adjacent to the photoconductive member; and an elongated magnet disposed interiorly of said tubular member for attracting developer material thereto.

13. A printing machine according to claim 12, wherein said electrical biasing means electrically biases said tubular member with the wave form of the electrical bias removing from the carrier granules a substantially uniform distribution of magnetic toner particles ranging in size from less than 4 micrometers to greater than 18 micrometers and develops the latent image therewith.

14. A printing machine according to claim 13, wherein the toner particles have a concentration of magnetite of at least 25% by weight.

* * * * *